US008627688B2

(12) United States Patent
Volpato et al.

(10) Patent No.: US 8,627,688 B2
(45) Date of Patent: Jan. 14, 2014

(54) UNBALANCE CONTROL SYSTEM FOR VERTICAL-ROTATION-AXIS WASHING MACHINES

(75) Inventors: Alvaro Volpato, Guabirotuba (BR); Jose Machado, Guabirotuba (BR); Daniel Kaminski de Souza, Guabirotuba (BR); Marco Giovagnoni, Udine, UT (US); Fabio Altinier, Codogne (IT); Stefano Galassi, Ranzano (IT)

(73) Assignee: Electrolux Home Products Corporation N.V., Brussels (BE)

( * ) Notice: Subject to any disclaimer, the term of this patent is extended or adjusted under 35 U.S.C. 154(b) by 1203 days.

(21) Appl. No.: 12/513,777

(22) PCT Filed: Nov. 16, 2007

(86) PCT No.: PCT/EP2007/009915

§ 371 (c)(1),
(2), (4) Date: Jun. 18, 2009

(87) PCT Pub. No.: WO2008/061675

PCT Pub. Date: May 29, 2008

(65) Prior Publication Data

US 2010/0236295 A1 Sep. 23, 2010

(30) Foreign Application Priority Data

Nov. 23, 2006 (EP) ..... 06124608

(51) Int. Cl.
*D06F 33/00* (2006.01)

(52) U.S. Cl.
USPC ..... 68/12.06; 68/3 R; 8/158; 8/159

(58) Field of Classification Search
USPC ..... 68/3 R
See application file for complete search history.

(56) References Cited

U.S. PATENT DOCUMENTS 6,460,381 B1 10/2002 Yoshida et al.
2002/0194682 A1 12/2002 Conrath

FOREIGN PATENT DOCUMENTS

EP 0972874 1/2000
JP 08071290 3/1996

OTHER PUBLICATIONS

International Search Report for PCT/EP2007/009915 dated Feb. 22, 2008.
Jan. 10, 2011 Office Action issued in corresponding Chinese Application No. 200780041944.1.
Apr. 20, 2007 EP Search Report, and Examination Report, issued in corresponding European Application No. 06124608.8.

*Primary Examiner* — Jason Ko
(74) *Attorney, Agent, or Firm* — Banner & Witcoff, Ltd.

(57) ABSTRACT

There is described a control system (15) for controlling unbalance of the wash assembly (5) in a vertical-rotation-axis washing machine (1), wherein a wash assembly (5) is housed inside a casing (2), and has a wash drum (8) rotating about an axis of rotation (R) substantially parallel to a vertical reference axis (V), and an electric drive unit (12) for rotating the wash drum (8) about the relative axis of rotation (R); said control system has first computing blocks (19, 20, 21) for determining a number of operating quantities (Cm(t), J, alpha (t)) associated with rotation of the wash drum (8), and for determining, as a function of the quantities, the time pattern of the amplitude (h(t)) of vertical oscillation of the centre of mass (B) of the wash assembly (5) in a first direction substantially parallel to the vertical reference axis (V); and a second computing block (23) for determining the maximum amplitude (H) of vertical oscillation of the wash assembly (5) within a given time interval (T); the second computing block (23) also determines whether the maximum amplitude (H) of vertical oscillation satisfies a predetermined relationship with a predetermined threshold (SA), and determines a critical unbalanced condition of the wash assembly (5) when the predetermined relationship is satisfied.

8 Claims, 2 Drawing Sheets

UNBALANCE CONTROL SYSTEM FOR VERTICAL-ROTATION-AXIS WASHING MACHINES

BACKGROUND OF THE INVENTION

The present invention relates to a system for controlling unbalance of the wash assembly in a vertical-rotation-axis washing machine.

More specifically, in the following description, the term "vertical-rotation-axis washing machine" refers to a washing machine comprising a wash drum rotated by an electric drive unit about a substantially vertical axis or about an axis tilted with respect to a vertical axis.

As is known, in vertical-rotation-axis washing machines, unbalance of the wash assembly caused by the load inside the drum must be determined continuously during the spin cycle to adequately control rotation of the drum in the event of excessive unbalance, which could result in the wash assembly colliding with the outer casing of, and so damaging, the washing machine.

In washing machines of the above type, steps must also be taken to reduce vibration and walk of the machine on the supporting surface during the spin cycle.

In currently marketed vertical-axis washing machines, the above drawbacks are partly solved by appropriately calibrating a number of operating parameters characteristic of the wash cycle. Given the large number of parameters involved, however, calibration is complex and does not entirely eliminate the risk of collision of the wash assembly, and/or vibration, and/or walk of the washing machine referred to above.

SUMMARY OF THE INVENTION

It is an object of the present invention to provide a system for controlling unbalance of the wash assembly in a vertical-rotation-axis washing machine, and which prevents collision of the wash assembly with the casing, and, at the same time, greatly reduces vibration and/or walk of the washing machine.

According to the present invention, there is provided a system for controlling unbalance of the wash assembly in a vertical-rotation-axis washing machine, as claimed in the accompanying Claims.

BRIEF DESCRIPTION OF THE DRAWINGS

A non-limiting embodiment of the present invention will be described by way of example with reference to the accompanying drawings, in which.

DETAILED DESCRIPTION OF ILLUSTRATIVE EMBODIMENTS

The present invention is substantially based on the principle of:

structuring the wash assembly of a vertical-axis washing machine so that, as the wash drum and the load inside the drum rotate about the respective axis of rotation, the movement of the center of mass of the wash assembly has a vertical oscillatory component in a first direction substantially parallel to said vertical reference axis (V);

measuring a number of operating quantities associated with rotation of the drum and relative load, to determine, as a function of the quantity values, the amplitude-time pattern of said vertical oscillation of the center of mass of the wash assembly;

determining the maximum amplitude of vertical oscillation of the wash assembly in the vertical direction within a given time interval;

determining whether the maximum amplitude of vertical oscillation satisfies a predetermined relationship with a predetermined threshold;

determining a critical unbalanced condition of the wash assembly when said predetermined relationship is satisfied;

controlling the rotation speed of the drum, when said critical unbalanced condition is determined.

Figure 1:
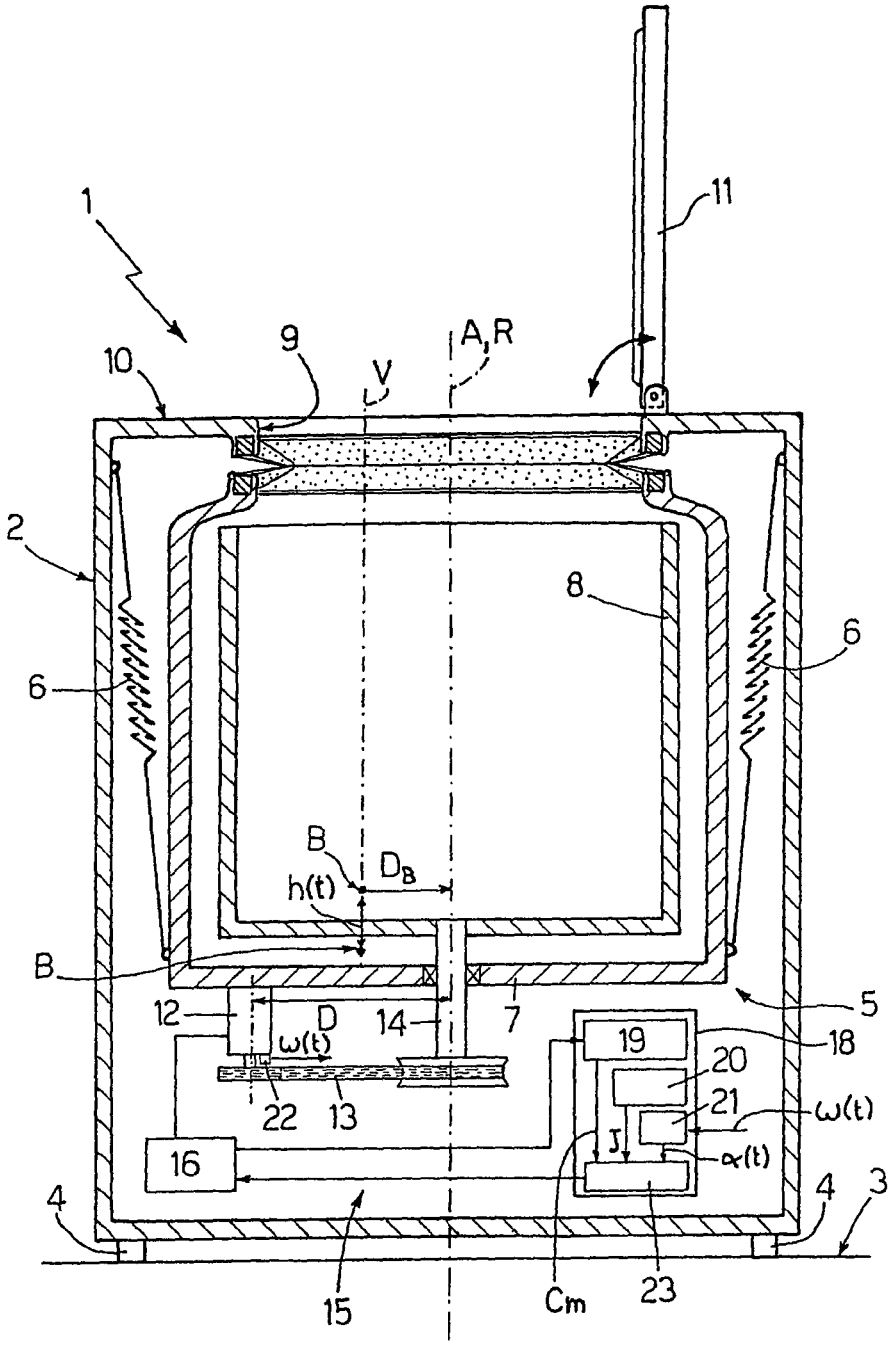
FIG. 1 shows schematically a washing machine featuring a system for controlling unbalance of the wash assembly in accordance with the present invention.

With reference to FIG. 1, number 1 indicates schematically as a whole a washing machine comprising a preferably, though not necessarily, parallelepiped-shaped outer casing 2 resting on a floor 3 on a number of feet 4.

Casing 2 houses a wash assembly 5, which is fixed to the lateral walls of casing 2 by a number of shock-absorbing devices 6, so that the longitudinal axis A of the wash assembly is substantially parallel to a vertical reference axis V, and which in turn substantially comprises a substantially cylindrical tub or wash chamber 7 housing a wash drum 8 rotated, inside tub or wash chamber 7, about an axis of rotation R substantially coaxial with longitudinal axis A of wash assembly 5.

Casing 2 has an opening 9 formed in the top wall 10 of casing 2 for access to drum 8; and a door 11 fixed to top wall 10 to seal opening 9.

Wash assembly 5 also comprises an electric drive unit 12, e.g. an electric motor, fixed to the base of wash chamber 7, and the output shaft of which is connected, via a drive member 13 comprising, for example, a drive belt, to a drive shaft 14 for rotating drum 8 and positioned coaxially with axis of rotation R.

More specifically, in the FIG. 1 example, electric drive unit 12 is fixed to the bottom wall of wash chamber 7, with its longitudinal axis at a distance D from the axis of rotation R of drum 8, so that the center of mass B of wash assembly 5 is not aligned with axis of rotation R. In the example shown, the center of mass B of wash assembly 5 without load is located a distance $D_B$ from axis of rotation R.

In an alternative embodiment not shown, electric drive unit 12 is fixed to the centre of the base of wash chamber 7, with its output shaft fitted or connected to the drive shaft 14 of drum 8; and wash assembly 5 has an additional portion of a given weight and fixed a predetermined distance from axis of rotation R, so that the center of mass B of wash assembly 5, without load, is not aligned with axis of rotation R, i.e. is located a distance $D_B$ from axis of rotation R.

Tests show that offsetting the center of mass B of wash assembly 5, with or without load, with respect to the axis of rotation R of drum 8, i.e. distancing center of mass B from axis of rotation R, produces a movement of the center mass B having a vertical oscillatory component due to the conical mode of vibration.

On the other hand, if the axis of rotation is not vertical the cylindrical mode of vibration produces a movement of the center mass B having a vertical oscillatory component.

In fact, the steady-state vibration of the washing assembly 5 due to the unbalance of the washing machine 1 load can be split into the following separate characteristic motions: the cylindrical motion and the conical motion.

In the cylindrical motion the axis of rotation R of drum 8 moves parallel to itself, thus geometrically defining a cylinder whose cross section is not necessarily circular: in most cases it is very close to an ellipse, more generally it is closed curve.

In the conical motion the axis of rotation R of drum 8 moves by changing its orientation with respect to an inertial frame of reference: during the conical motion the axis of rotation R positions belong to a cone whose cross sections are not necessarily circular: in most cases they are very close to an ellipse, more generally they are closed curves.

For the conical motion we can define a mean value of the angle $\alpha$ of the cone, while for the cylindrical motion we can define the mean radius r of the cross section. Moreover it is possible define a $\beta$ angle as the average value of inclination of the axis of rotation R respect to the vertical axis V when the washing machine 1 is spinning.

Considering steady-state conditions above described, the cylindrical motion of the axis of rotation R produces a vertical oscillatory motion of the center of mass B only if the axis is not vertical. In other words we can write $$h \cong r \cdot \sin\beta \cong r \cdot \beta$$

Considering again steady-state conditions, the conical motion produces a vertical oscillatory motion of the center of mass B only if the center of mass B itself does not belong to the axis of rotation R. In other words we can write:

$$h \cong \alpha \cdot D_M$$

where $D_M$ is the distance of the center of mass B of the washing assembly 5 with load inside the drum from axis of rotation R.

It turns out that in steady-state conditions and in the case of worst phase-relationship between conical and cylindrical motions we can have:

$$h \cong r \cdot \beta + \alpha \cdot D_M$$

From this formula we can see that the vertical motion h of the center of mass B is determined by the motion of the wash assembly 5 and by two parameters of the washing machine, namely the inclination $\beta$ of the axis of rotation R and the distance $D_M$ between the center of mass B and the axis of rotation R. In fact, for a washing machine with a perfectly vertical axis ($\beta$=0) and with the center of mass B belonging to the same axis ($D_M$=0), no vertical movement of the center of mass B can be produced by the vibration of the wash assembly. Therefore, under these circumstances the group vibration will not induce any modification in the torque or speed signal (i.e. in the unbalance function). On the other hand, larger inclination angles and/or larger distances of the center of mass B from the drum axis will induce stronger modifications in the torque and speed signals.

In the example shown, tests show the vertical movement of the center of mass B to be proportional to the degree of unbalance of wash assembly 5. The relationship between vertical movement h of the center of mass B and the degree of unbalance will be described in detail below.

Positioning electric drive unit 12 at a distance D from axis of rotation R, so as to distance the center of mass B from axis of rotation R, therefore produces, as drum 8 rotates, substantially vertical oscillations h(t) of wash assembly 5, which are proportional to the degree of unbalance of wash assembly 5.

Moreover the above vertical oscillatory component of the center mass B is also achieved positioning wash assembly 5 with its longitudinal axis A tilted considerably with respect to vertical reference axis V.

Washing machine 1 also comprises a control system 15 for determining a critical unbalanced condition of wash assembly 5 as described in detail below, and which controls electric drive unit 12 to adjust the rotation speed of drum 8 as a function of the critical unbalanced condition detected.

Control system 15 substantially comprises a control unit 16 for controlling electric drive unit 12; and a processing unit 18 for determining the presence or not of a critical unbalanced condition of wash assembly 5.

More specifically, processing unit 18 comprises a first computing block 19 for continuously supplying a value indicating the drive torque Tm(t) imparted by electric drive unit 12 to drum 8; a second computing block 20 for supplying a value J indicating the mass moment of inertia of the drum 8 and the load inside it; and a third computing block 21 for supplying a value indicating the angular acceleration $\alpha(t)$ of drum 8.

In the example shown, first computing block 19 may determine drive torque Tm(t) as a function of an electric current/voltage quantity generated by control unit 16 when controlling the rotation speed of the output shaft of electric drive unit 12; and mass moment of inertia J supplied by second computing block 20 may be determined experimentally by tests conducted directly on washing machine 1, and may then be memorized in second computing block 20.

Third computing block 21, on the other hand, may determine angular acceleration $\alpha(t)$ of drum 8 as a function of the rotation speed $\omega(t)$ measured directly on the output shaft of electric drive unit 12 by a speed sensor 22 defined, for example, by a speedometer dynamo mounted coaxially with the output shaft.

Processing unit 18 also comprises a fourth computing block 23, which receives motor drive torque Tm(t), mass moment of inertia J, and angular acceleration $\alpha(t)$ from the first, second, and third computing block respectively, and determines, by means of an unbalance function A(t) and on the basis of the above quantities, a critical unbalanced condition, upon which, control unit 16 activates a reduction in the rotation speed $\omega(t)$ of drum 8.

More specifically, fourth computing block 23 implements the unbalance function $A(t)=Tm(t)-J^*\alpha(t)$, the time pattern of which is related to vertical motion h(t) of the wash assembly 5. It is important point out that the relationship between the unbalance function $A(t)=Tm(t)-J^*\alpha(t)$ and the vertical motion h(t) of wash assembly 5 is based on the following considerations.

In steady-state conditions, i.e. when the drum 8 runs at a constant average speed, the behavior of the wash assembly 5 is periodic and thus the unbalance function A(t) is periodic too.

We can approximate the unbalance function A(t) by considering only its constant term and its first harmonics: in this way we neglect the second and the higher harmonics, but their contribution is not important. Thus we can write $$A(t) \cong A_0 + A_1 \cdot \cos(w \cdot t) \qquad \text{a)}$$

Introducing now this approximated unbalance function A(t) in the following known power equation of the washing machine:

$$T_m - J \cdot \alpha \cong T_{frictions} + M \cdot g \cdot \frac{dh}{dt} \cdot \frac{1}{\omega} \qquad \text{b)}$$

we have:

$$A_0 + A_1 \cdot \cos(\omega \cdot t) \cong T_{frictions} + M \cdot g \cdot \frac{dh}{dt} \cdot \frac{1}{\omega} \qquad \text{c)}$$

where $T_{frictions}$ is a friction torque, M is the total mass of the wash assembly 5 and the relative load, g is the gravity acceleration, and h is the vertical coordinate of the center mass B of the wash assembly 5 and the load.

Now, in steady-state conditions we have a constant energy dissipation (averaged on one drum 8 revolution) so that we can state $T_{frictions}$ is constant.

Moreover, the vertical position h(t) of the center of mass B is also a periodic function and, as we have done with the unbalance function A(t), we can approximate it with its constant term and its first harmonics. In other words, we can write $$h(t) \cong h_0 + h_1 \cdot \cos(\omega \cdot t + \Phi) \quad \text{d)}$$

Differentiating now with respect to time t we obtain $$\frac{dh}{dt} \cong \omega \cdot h_1 \cdot \cos(\omega \cdot t + \phi + \pi/2) \quad \text{e)}$$

Introducing now the expression e) in the power equation b) we obtain $$A_0 + A_1 \cdot \cos(\omega \cdot t) \cong T_{frictions} + M \cdot g \cdot \omega \cdot h_1 \cdot \cos(\omega \cdot t + \phi + \pi/2) \cdot \frac{1}{\omega} \quad \text{f)}$$

from which we see that it is $$A_0 \cong T_{frictions} \Phi \cong -\pi/2 A_1 \cong M \cdot g \cdot h_1$$

From the latter of these formulas we find out that:

$$h_1 \cong \frac{A_1}{M \cdot g}$$

It is important to point out that the amplitude of the first harmonics of the vertical motion $h_1$ of the center of mass B is proportional to the amplitude $A_1$ of the first harmonics of the unbalance function A(t).

This means that sampling both torque Tm and speed w, it is possible to compute by fourth computing block 23 the unbalance function A(t) continuously during spinning and the amplitude $A_1$ of its first harmonics run time for determining the amplitude $h_1$ of the vertical motion of the center of mass B.

Figure 2:
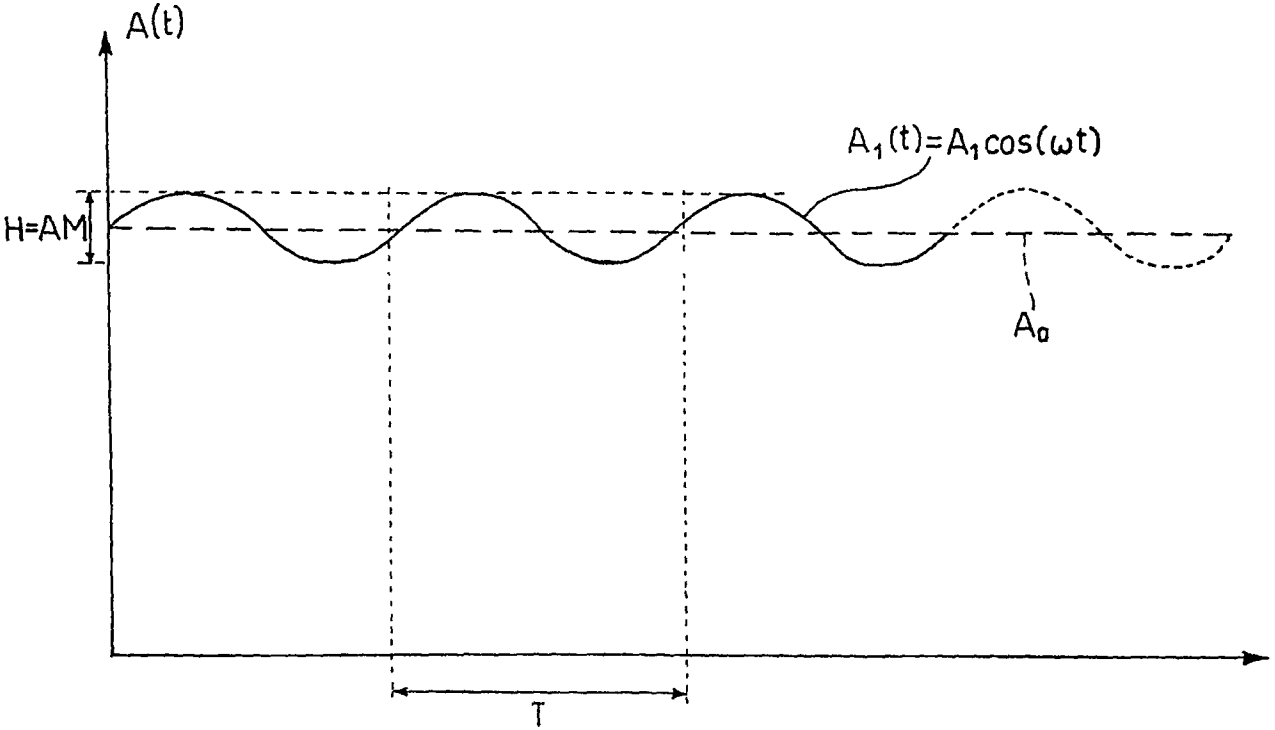
FIG. 2 shows a graph of a function related to unbalance of the wash assembly of the FIG. 1 washing machine.

FIG. 2 shows a graph of the unbalance function A(t) determined by fourth computing block 23 and related to vertical movement h(t) of the centre of mass B of wash assembly 5.

More specifically, unbalance function A(t) shown in FIG. 2 comprises a continuous component which corresponds to a constant term $A_0$, and a substantially undulatory component which correspond to the first harmonic $A_1(t)$ whose amplitude is proportional to vertical oscillation component $h_1(t)=h_1 \cos(\omega t)$ of the centre of mass B of wash assembly 5.

Fourth block 23 determines the maximum amplitude value of component $A_1(t)$, i.e. the peak-to-peak value AM of unbalance function $A_1(t)$, within each predetermined time interval T corresponding, for example, to a period in the undulatory pattern of unbalance function A(t), and calculates, as a function of maximum value $A_1(t)$, a value indicating the maximum amplitude $h_1(t)=H$ of vertical oscillation of centre of mass B within interval T.

Fourth block 23 also determines a predetermined relationship between maximum amplitude H of the vertical movement of centre of mass B and a predetermined threshold SA associated with a critical unbalanced condition of wash assembly 5.

Predetermined threshold SA may be determined and memorized by tests performed beforehand on washing machine 1, and may be correlated with an oscillation value $h_1(t)$ of centre of mass B resulting, when exceeded, in a critical unbalanced condition of wash assembly 5.

More specifically, the predetermined relationship determined by computing block 23 may be satisfied when the maximum amplitude H determined exceeds predetermined threshold SA.

When maximum amplitude H exceeds predetermined threshold SA, fourth computing block 23 determines a critical unbalanced condition of wash assembly 5, and accordingly informs control unit 16, which reduces the rotation speed ω(t) of drive unit 12 to eliminate the critical unbalanced condition.

In the example shown, control unit 16 may reduce the rotation speed ω(t) of electric drive unit 12 by a predetermined value, or may command reduction of rotation speed ω(t) as a function of the maximum oscillation H determined.

Control system 15 as described above is extremely advantageous, by determining critical unbalanced conditions of wash assembly 5 simply and economically, and by intervening to reduce rotation speed ω(t) when the degree of unbalance exceeds a predetermined critical threshold.

Clearly, changes may be made to the washing machine and system as described and illustrated herein without, however, departing from the scope of the present invention as defined in the accompanying Claims.

The invention claimed is:

1. A vertical-rotation-axis washing machine comprising an outer casing; a wash assembly housed inside the casing and comprising a wash drum rotatable about an axis of rotation substantially parallel to a vertical reference axis, and an electric drive unit for rotating said wash drum about the axis of rotation; and a control system for controlling unbalance of the wash assembly; said wash assembly being structured so that as the wash drum and a load inside the wash drum rotate about the axis of rotation, the movement of a center of mass of the wash assembly has a vertical oscillatory component in a first direction substantially parallel to said vertical reference axis;

said control system comprising:

a processing unit configured to determine a number of operating quantities associated with rotation of said wash drum, and for determining, as a function of said quantities, a time pattern of the amplitude of vertical oscillations of said centre of mass of said wash assembly in a first direction substantially parallel to said vertical reference axis;

the processing unit being further configured to determine from said time pattern a maximum amplitude of said vertical oscillations of the wash assembly in said first direction within a given time interval; said processing unit determining whether the maximum amplitude of the vertical oscillations satisfy a predetermined relationship with a predetermined threshold, and determining a critical unbalanced condition of the wash assembly when said predetermined relationship is satisfied;

wherein said processing unit determines the time pattern of the amplitude of vertical oscillations of the centre of mass of said wash assembly in said first direction on the basis of the following unbalance function:

$$A(t) = Tm(t) - J^* \alpha(t)$$

where Tm(t) is the drive torque imparted by the electric drive unit to said wash drum; J is the mass moment of inertia of the wash drum and the load inside it; and α(t) is the angular acceleration α(t) imparted to the wash drum.

2. The washing machine as claimed in claim 1, wherein said wash assembly is structured so that its centre of mass, with or without load inside the wash drum, is located a predetermined distance from said axis of rotation of said wash drum.

3. The washing machine as claimed in claim 1, wherein said wash assembly is structured so that said axis of rotation is tilted, but not perpendicular, with respect to said vertical reference axis.

4. The washing machine as claimed in claim 1, wherein said wash assembly comprises a wash chamber housing said wash drum; said electric drive unit being fixed to a bottom wall of the wash chamber at a predetermined distance from the axis of rotation of the wash drum, so that the centre of mass of the wash assembly is not aligned with the axis of rotation.

5. The washing machine as claimed in claim 1, and comprising control means configured to command, upon said critical unbalanced condition occurring, a reduction in a rotation speed of an output shaft of said electric drive unit.

6. The washing machine as claimed in claim 5, wherein said control means are configured to command, upon said critical unbalanced condition occurring, a reduction in the rotation speed of the output shaft of said electric drive unit as a function of the maximum amplitude of said vertical oscillations of the wash assembly determined by said processing unit.

7. The washing machine as claimed in claim 2, wherein said wash assembly is structured so that said axis of rotation is tilted, but not perpendicular, with respect to said vertical reference axis.

8. The washing machine as claimed in claim 1, and comprising control means configured to command, upon said critical unbalanced condition occurring, a reduction in a rotation speed of an output shaft of said electric drive unit.

* * * * *